US008079881B2

(12) United States Patent
Hogan et al.

(10) Patent No.: US 8,079,881 B2
(45) Date of Patent: Dec. 20, 2011

(54) CONNECTOR SHELL HAVING INTEGRALLY FORMED CONNECTOR INSERTS

(75) Inventors: Kevin Matthew Hogan, Sinking Spring, PA (US); Kevin Michael Thackston, York, PA (US)

(73) Assignee: Tyco Electronics Coporation, Berwyn, PA (US)

( * ) Notice: Subject to any disclaimer, the term of this patent is extended or adjusted under 35 U.S.C. 154(b) by 82 days.

(21) Appl. No.: 12/478,918

(22) Filed: Jun. 5, 2009

(65) Prior Publication Data

US 2010/0311282 A1 Dec. 9, 2010

(51) Int. Cl.
*H01R 13/64* (2006.01)

(52) U.S. Cl. ..... 439/680

(58) Field of Classification Search ..... 439/680, 439/76.2

See application file for complete search history.

(56) References Cited

U.S. PATENT DOCUMENTS 4,871,320 A * 10/1989 Mouissie ..... 439/78
4,998,887 A * 3/1991 Kaufman et al. ..... 439/78
5,823,826 A 10/1998 Ward et al.
6,413,119 B1 7/2002 Gabrisko, Jr. et al.
2003/0162421 A1 8/2003 Pratt et al.

FOREIGN PATENT DOCUMENTS

DE 31 14 223 2/1982
EP 1 538 717 6/2005

OTHER PUBLICATIONS

European Search Report, International Application No. EP 10 16 4845.

* cited by examiner

*Primary Examiner* — Vanessa Girardi

(57) ABSTRACT

A connector shell includes a frame, a dividing wall and a plurality of connector inserts. The frame surrounds a periphery of the shell. The dividing wall is homogeneously formed with the frame and separates a plurality of recesses. The connector inserts are homogeneously formed with the frame and the dividing wall. The inserts are disposed with one or more of the recesses. Each insert includes a body and a plurality of cavities. Each body is configured to hold a plurality of contacts that protrude from each of a mating and a loading side. The contacts are configured to be mounted to a circuit board in a location proximate to the loading side and to mate with a plurality of other electrical connectors in a location proximate to the mating side.

16 Claims, 4 Drawing Sheets

CONNECTOR SHELL HAVING INTEGRALLY FORMED CONNECTOR INSERTS

CROSS-REFERENCE TO RELATED APPLICATIONS

This application is related to co-pending U.S. patent application Ser. No. 12/478,935, (the "'031 Application"). The '031 Application is being filed on Jun. 5, 2009 and is entitled "Connector Assembly Having A Unitary Housing." The entire disclosure of the '031 Application is incorporated by reference herein in its entirety.

BACKGROUND OF THE INVENTION

The subject matter herein relates generally to electrical connectors and more particularly to a connector shell having integrally formed connector inserts.

Aeronautical Radio, Inc. ("ARINC") is a commercial standards group governing connectors, connector sizes, rack and panel configurations, etc primarily for airborne applications. Connectors which conform to ARINC specifications are sometimes referred to as ARINC connectors or connector assemblies. One example includes the known ARINC 600 receptacle that holds size 22 electrical contacts. The ARINC 600 receptacle holds 150 electrical contacts using a housing formed of multiple sections.

FIG. 1 is an exploded view of a known ARINC 600 connector insert 700. The ARINC 600 connector insert 700 includes a body divided into a front section 702 and a rear section 704. In order to assemble the ARINC 600 connector insert 700, a contact retention clip 706 is loaded into the front section 702 for each of a plurality of contacts 708. The contact retention clip 706 is loaded into one of a plurality of cavities 710 that extend through the front section 702. The rear section 704 is then bonded to the front section 702. The rear section 704 includes a plurality of cavities 712 that correspond to the cavities 710 in the front section 702. The electrical contacts 708 then are inserted, one at a time, into the cavities 710, 712 in the bonded front and rear sections 702, 704. The retention clips 706 engage the contacts 708 to secure the contacts 708 in the front and rear sections 702, 704. The ARINC 600 connector insert 700 thus includes a relatively large number of parts that are individually assembled together.

A need therefore exists for an ARINC 600 receptacle that is simpler to manufacture than known receptacles.

BRIEF DESCRIPTION OF THE INVENTION

In one embodiment, a connector shell includes a frame, a dividing wall and a plurality of connector inserts. The frame surrounds a periphery of the shell. The dividing wall is homogeneously formed with the frame and separates a plurality of recesses. The connector inserts are homogeneously formed with the frame and the dividing wall. The inserts are formed within one or more of the recesses. Each insert includes a body and a plurality of cavities. Each body is configured to hold a plurality of contacts that protrude from each of a mating and a loading side. The contacts are configured to be mounted to a circuit board in a location proximate to the loading side and to mate with a plurality of other electrical connectors in a location proximate to the mating side.

In another embodiment, a connector shell includes a frame, a dividing wall and a plurality of connector inserts. The frame surrounds a periphery of the shell. The dividing wall is homogeneously formed with the frame and separates a plurality of recesses. The inserts are disposed within one or more of the recesses. Each of the inserts includes a mounting portion of a body that is configured to couple with a mating portion. The mounting and mating portions are configured to hold a plurality of contacts that protrude from a loading side of the body and are configured to be mounted to a circuit board in a location that is proximate to the loading side. At least one of the mounting and mating portions is homogeneously formed with the frame and the dividing wall as a unitary body; and the other of the mounting and mating portions is coupled to the frame and dividing wall.

DETAILED DESCRIPTION OF THE INVENTION

Figure 2:
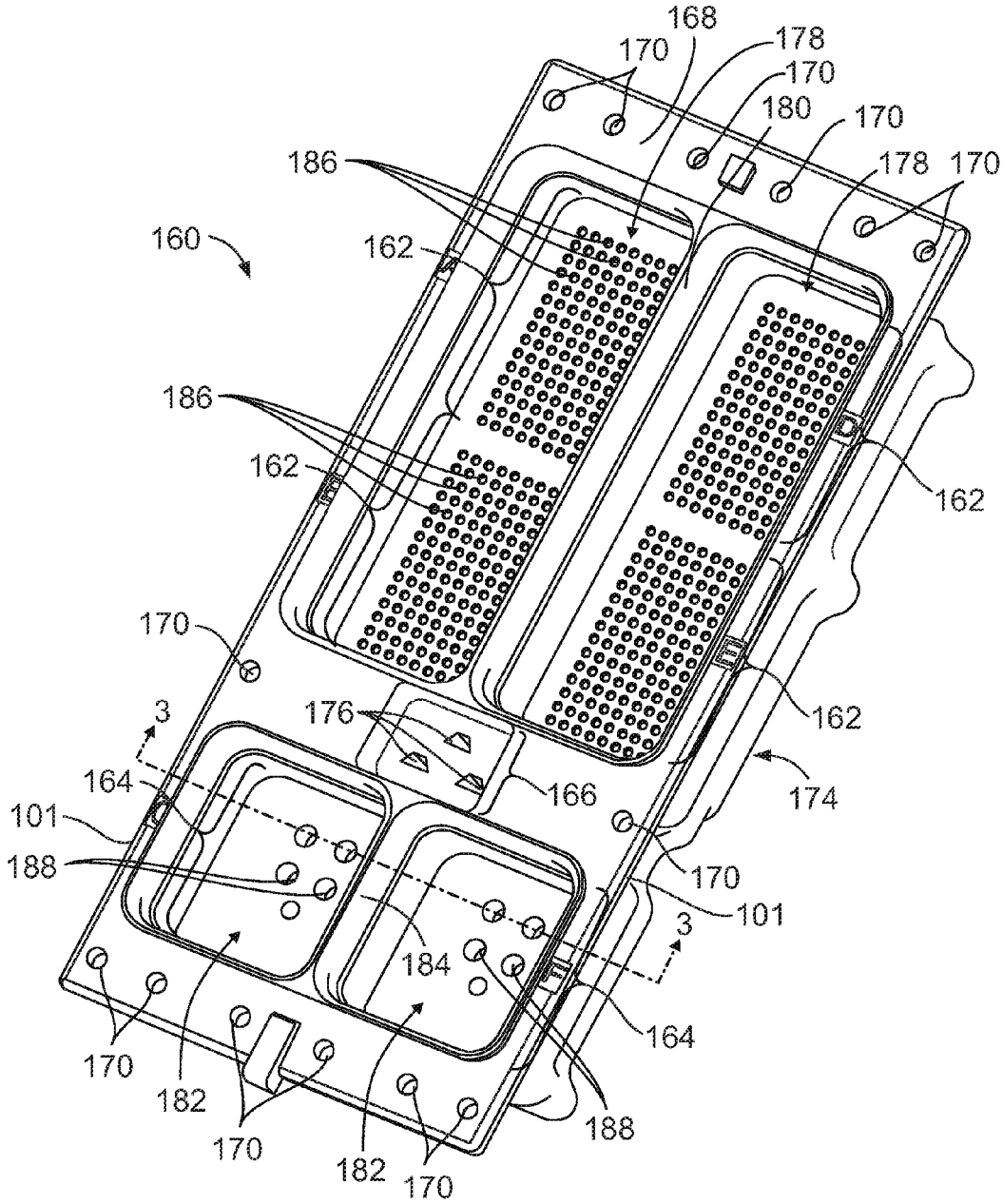
FIG. 2 is a front perspective view of a connector shell according to one embodiment.

FIG. 2 is a front perspective view of a connector shell 160 according to one embodiment. The shell 160 includes a plurality of signal pin connector inserts 162, a plurality of power pin connector inserts 164, and a keying feature 166. In the illustrated embodiment the shell 160 may include the same number of connector inserts 162, 164 as an SZ 3 ARINC connector shell. Alternatively, the shell 160 may include a different number of connector inserts 162, 164. For example, the shell 160 may include two signal inserts 162 and a single power insert 164, similar to a SZ 2 ARINC connector shell. In another embodiment, the shell 160 may include smaller inserts 162, 164. For example, the shell 160 may resemble a SZ 1 ARINC connector shell having two signal inserts 162 and a single power insert 164, with each insert 162, 164 being approximately half as large as the inserts 162, 164 in the SZ 2 ARINC connector shell. The periphery of the signal connector inserts 162, power connector inserts 164 and keying feature 166 is surrounded by a frame 168. In one embodiment, the signal connector inserts 162, power connector inserts 164 and keying feature 166 are integrally formed with the frame 168. For example, the signal connector inserts 162, power connector inserts 164, keying feature 166, and frame 168 may be molded as a single piece of dielectric material. In one embodiment, the signal connector inserts 162, power connector inserts 164, keying feature 166, and frame 168 are molded from a composite plastic material. For example, the shell 160 may be formed so that two or more of the signal connector inserts 162, the power connector inserts 164, the keying feature 166 and the frame 168 are homogeneously formed with one another as a unitary body.

The shell 160 includes a plurality of through holes 170 in the frame 168. Screws may be inserted through the through holes 170 to secure the shell 160 to a panel (not shown). In another embodiment, the through holes 170 are threaded holes. In the illustrated embodiment, a plurality of the signal connector inserts 162 is held in each of a plurality of signal insert recesses 178. The signal insert recesses 178 are surrounded by the frame 168 and a dividing wall 180. The dividing wall 180 may extend from and be integrally formed with the frame 168. For example, the dividing wall 180 and frame 168 may be homogeneously formed with one another. In another embodiment, a different number of the signal connector inserts 162 is included in one or more of the signal insert recesses 178. Each of the power connector inserts 164 is held in each of a plurality of power insert recesses 182. The power insert recesses 182 are surrounded by the frame 168 and another dividing wall 184. The dividing wall 184 may extend from and be integrally formed with the frame 168. For example, the dividing wall 184 and the frame 168 may be homogeneously formed with one another. In another embodiment, a greater number of power connector inserts 164 is included in one or more of the power insert recesses 182. In the illustrated embodiment, the two dividing walls 180, 184 are co-linear with respect to one another.

The signal connector inserts 162 include a plurality of cavities 186. The power connector inserts 164 include a plurality of cavities 188. The cavities 186, 188 are configured to receive a plurality of electrical contacts (not shown). The electrical contacts held by the signal and power connector inserts 162, 164 may be mounted to a circuit board (not shown) by inserting the shell 160 into an opening (not shown) in a panel (not shown) and mounting the electrical contacts onto the circuit board. One or more electrical connectors (not shown) may mate with the electrical contacts held by the signal and power connector inserts 162, 164 by mating the electrical connectors with the electrical contacts.

In one embodiment, the power connector inserts 164 may hold electrical contacts (not shown) that are used to communicate power between a peripheral device (not shown) and a circuit board (not shown). For example, the power connector inserts 164 may hold a plurality of posted contacts or the electrical contacts 14 (shown in FIG. 2) that are mounted on a circuit board and that mate with electrical connectors (not shown) of the peripheral device. In another embodiment, the power connector inserts 164 may hold crimp contacts (not shown) that are used to communicate power between the peripheral device and a circuit board or another peripheral device. For example, a crimped cable (not shown) may be electrically connected to the crimp contacts held by one or more of the power connector inserts 164. The crimp cable may then communicate power between one peripheral device electrically connected to the crimp contacts and another peripheral device electrically connected to the crimp cable. In other embodiments, the power connector inserts 164 may hold electrical contacts that are used to communicate an electronic data signal between the peripheral device(s) and the circuit board.

The keying feature 166 includes a plurality of key holes 176. In one embodiment, the key holes 176 receive one or more alignment features (not shown) that extend upwards from a device (not shown) or circuit board (not shown) with which the shell 160 is mated. For example, the key holes 176 may receive alignment pins (not shown) that extend upwards from the device with which the shell 160 is mated. The orientation of the alignment pins and the key holes 176 may assist in orienting the shell 160. The shell 160 may be oriented by the keying feature 166 to ensure that the electrical contacts in the signal and power connector inserts 162, 164 are properly aligned and oriented with respect to a mating connector (not shown). The key holes 176 may be provided as part of the mold tooling used to create the shell 160. For example, the key holes 176 may be formed when the shell 160 is molded, without requiring the use of additional tools or pieces to create the key holes 176 once the shell 160 is molded. For example, by providing the key holes 176 when the shell 160 is molded, the orientation of the key holes 176 may be set within a hex cavity.

One or more of the signal and power connector inserts 162, 164 may be formed similar to a connector insert 10 described below in connection with FIG. 4. The signal and/or power connector inserts 162, 164 may be homogeneously formed as a unitary body with the shell 160. For example, the signal and/or power connector inserts 162, 164 may be molded along with the shell 160 from a dielectric material.

Figure 1:
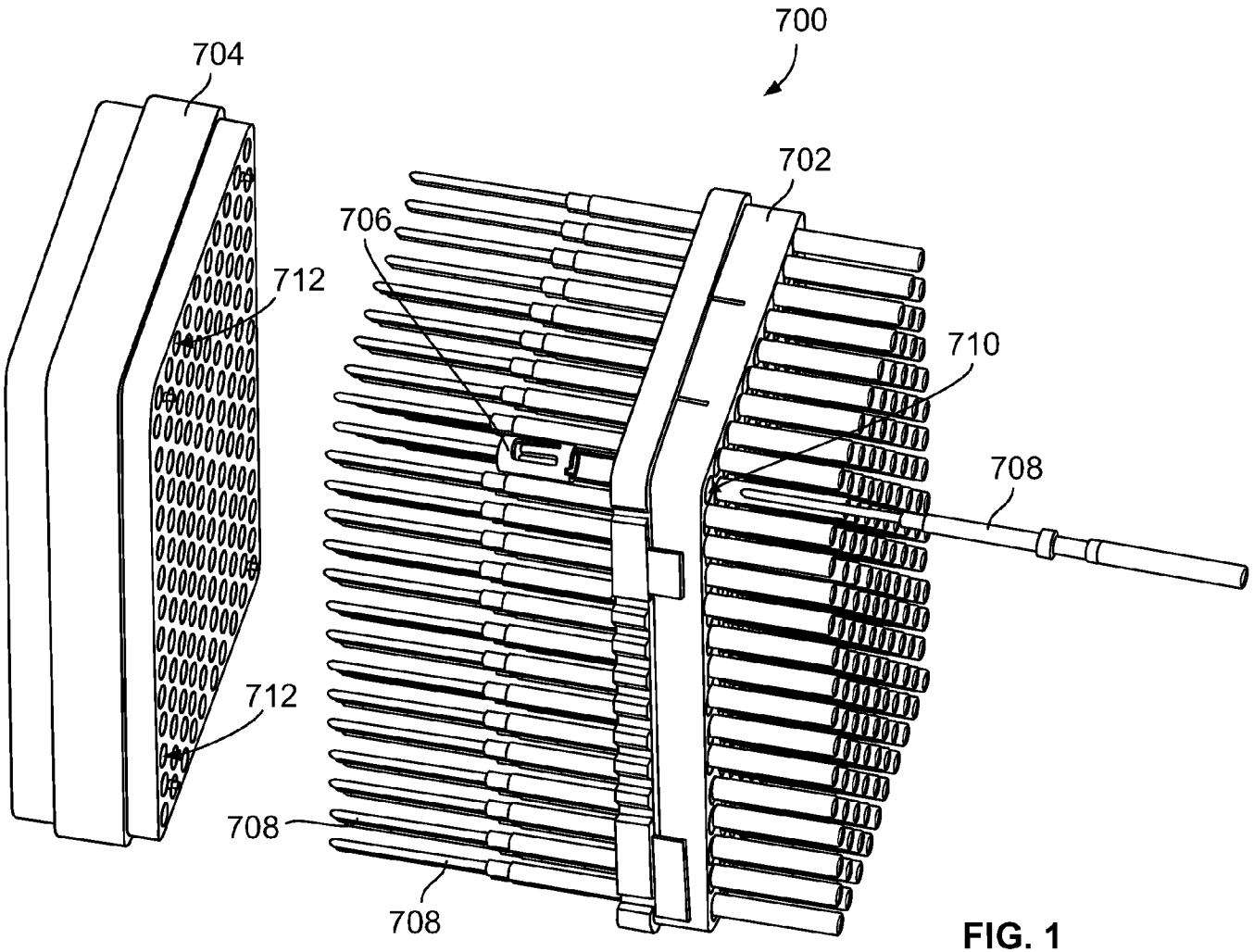
FIG. 1 (PRIOR ART)
FIG. 1 is an exploded view of a known ARINC 600 connector insert.

Alternatively, one or more of the signal and power connector inserts 162, 164 may be separately formed from the shell 160 and later coupled to the shell 160. For example, one or more of the signal and power connector inserts 162, 164 may be separately formed from the shell 160 and fixed to the shell 160 by an adhesive, mechanical connection, and the like. In another embodiment, one or more of the signal connector inserts 162 is divided into at least two components. For example, the signal connector inserts 162 may include front and rear sections similar to the front and rear sections 702, 704 (shown in FIG. 1). One of the front and rear sections 702, 704 is formed as part of the shell 160. For example, the rear section 704 of a signal connector insert 162 may be homogeneously formed as a unitary body with the shell 160. Contact retention clips similar to the contact retention clip 706 (shown in FIG. 1) may then be loaded into the front section 702, with the front section 702 then bonded to the rear section 704. Alternatively, the front section 702 of the signal connector insert 162 may be homogeneously formed as a unitary body with the shell 160. The contact retention clips 706 may then be loaded into the front section 702 and the rear section 704 bonded thereto.

Figure 3:
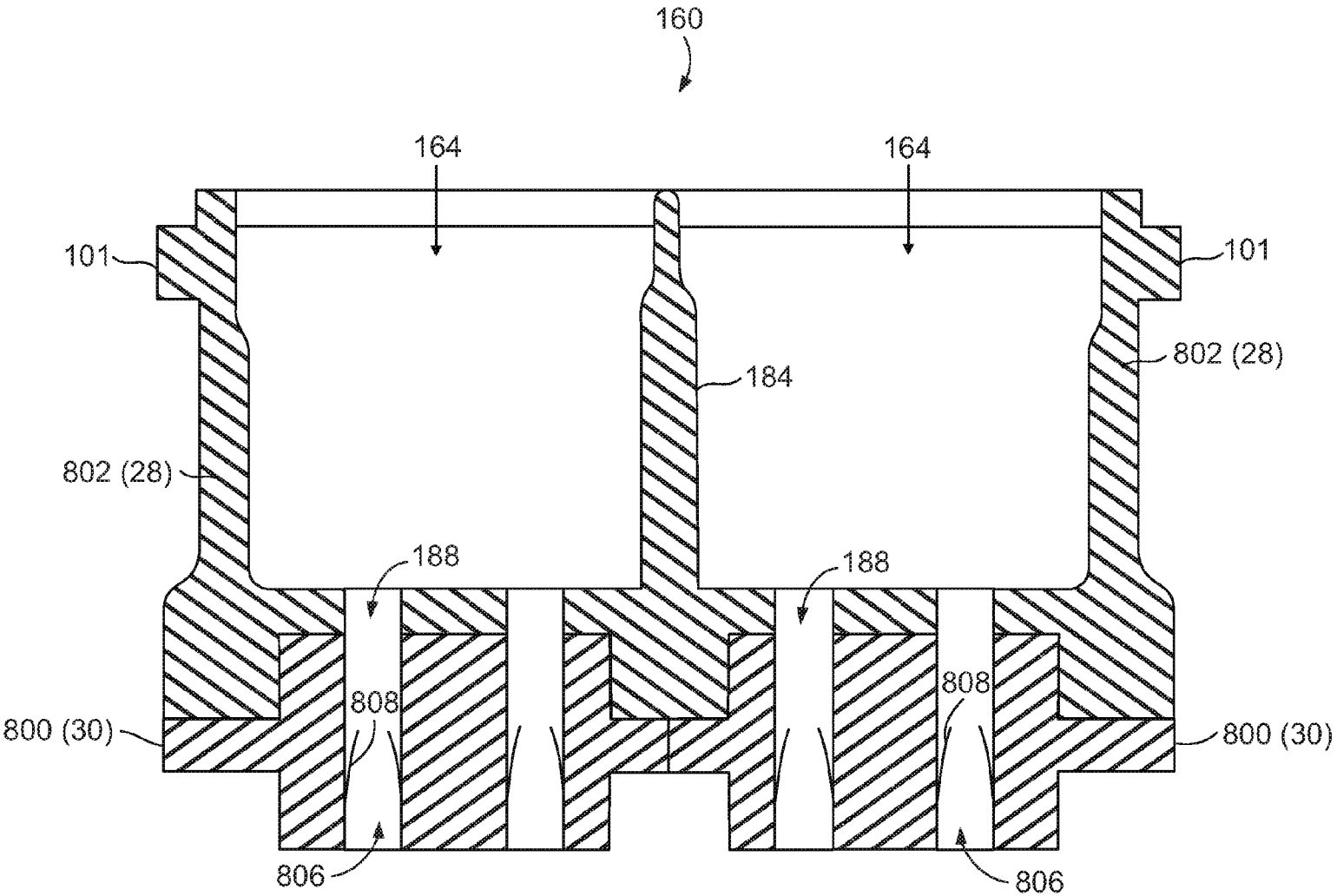
FIG. 3 is a partial cross-sectional view of the shell shown in FIG. 2 taken along line 3-3 in FIG. 2.

FIG. 3 is a cross-sectional view of the shell 160 taken along line 3-3 in FIG. 2 with a rear portion 800 of each of the power connector inserts 164 bonded thereto. In the illustrated embodiment the shell 160 includes a front portion 802 of each of the power connector inserts 164. The front portion 802 of each power connector insert 164 may be homogeneously or integrally formed with the shell 160 as a unitary body. In one embodiment, the front portion 802 corresponds to a mating section 28 of a body 12 for a connector insert 162 described below in connection with FIG. 4. The rear portion 800 may correspond to a mounting section 30 (shown in FIG. 3) of the connector insert 162 described below. In another embodiment, the front portion 802 corresponds to the mounting section 30 and the rear portion 800 corresponds to the mating section 28. Alternatively, the front and rear portions 800, 802 may be integrally or homogeneously formed with one another. For example, the front and rear portions 800, 802 may be a unitary piece with a plurality of cavities (not shown) in place of the cavities 188, 806. The rear portion 800 includes a plurality of cavities 806 that are aligned with the cavities 188 and are configured to receive and hold a plurality of electrical contacts (not shown).

In the illustrated embodiment, a plurality of contact retention clips 808 are inserted into the cavities 806 prior to coupling the front and rear portions 800, 802. The contact retention clips 808 may be similar to the contact retention clips 706 (shown in FIG. 1). Once the contact retention clips 808 are inserted into the cavities 806, the rear portion 800 may be coupled to the front portion 802. The rear portion 800 may be secured to the front portion 802 using one or more retention clips, filler plugs, threaded connections adhesives, and the like. Contacts (not shown) may be loaded into the cavities 188, 806 of the power connector inserts 164 and secured in the cavities 188, 806 by the contact retention clips 808.

Figure 4:
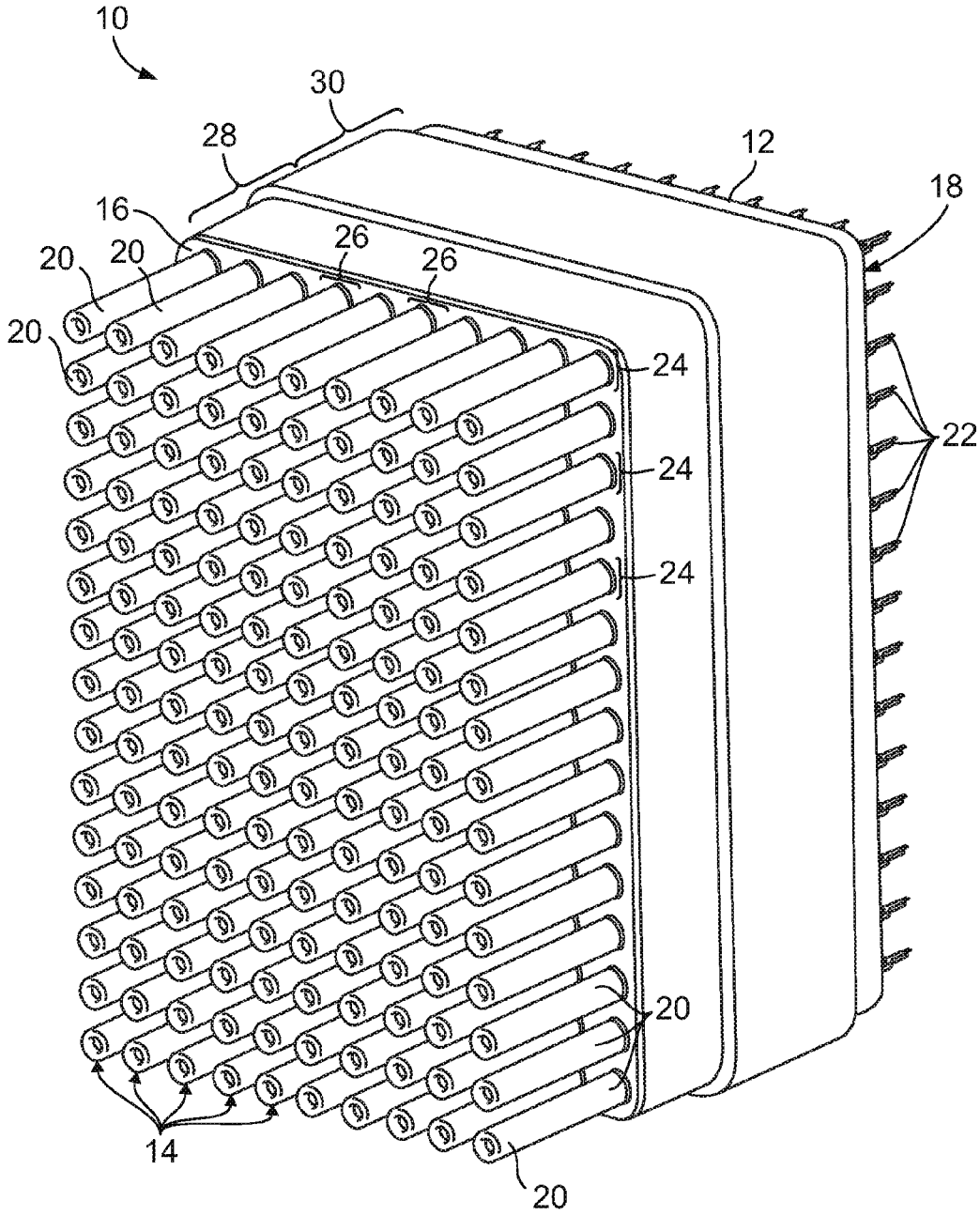
FIG. 4 is a front perspective view of a connector insert according to one embodiment.

FIG. 4 is a front perspective view of a connector insert 10 according to one embodiment. The connector insert 10 may be similar to the connector insert described in the co-pending '031 application. In one embodiment, the shell 160 may include one or more of the inserts 10 integrally molded with the shell 160 in place of one or more of the inserts 162, 164. For example, the insert 10 may be homogeneously formed as a unitary body with the shell 160. The connector insert 10 includes a body 12 that holds a plurality of electrical contacts 14. The body 12 may be formed of a single piece of material. For example, the body 12 may be molded as a single piece of dielectric material. The body 12 may be formed from a molded plastic composite material. For example, the body 12 may be homogeneously formed as a single unitary body. In another embodiment, the body 12 is divided into two or more pieces that are joined together. For example, the body 12 may include a mating section 28 and a mounting section 30. The mating and mounting sections 28, 30 may be molded as separate components and then secured together. For example, the mating and mounting sections 28, 30 may be secured together using one or more latches, threaded connections, adhesives, and the like.

The electrical contacts 14 protrude from a body mating side 16 and a loading side 18. A mating hood 20 of each electrical contact 14 protrudes from the body mating side 16. A mounting pin 22 of each electrical contact 14 protrudes from the loading side 18. As described below, the electrical contacts 14 are inserted, or loaded, into the body 12 through the loading side 18.

In one embodiment the connector insert 10 is an electrical connector that complies with the ARINC 600 standard. For example, the connector insert 10 may be an insert configured for use in an Air Transport Rack ("ATR") or Modular Component Unit ("MCU") for line-replaceable electronic units used in aircraft. In another embodiment, the connector insert 10 is an electrical connector that can mate with one or more other electrical connectors by mating the other electrical connectors with the mating hoods 20 of the electrical contacts 14.

In the illustrated embodiment, the connector insert 10 includes 150 electrical contacts 14. The electrical contacts 14 may be arranged in a plurality of rows 24 and columns 26. In the embodiment shown in FIG. 4, the connector insert 10 includes fifteen rows 24 and ten columns 26. Alternatively, the connector insert 10 may include a different number of electrical contacts 14, rows 24 and/or columns 26.

The connector insert 10 may be mounted onto a circuit board (not shown). For example, the mounting pins 22 may be inserted into the circuit board to establish an electrical connection between one or more conductive traces (not shown) in the circuit board and the electrical contacts 14. One or more electrical connectors (not shown) may mate with the connector insert 10 by mating one or more of the mating hoods 20 with one or more corresponding electrical contacts (not shown) of the electrical connectors. The electrical contacts 14 provide an electronic signal path between the electrical connectors and the circuit board once the electrical connectors are mated with the mating hoods 20 and the mounting pins 22 are mounted onto the circuit board.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector shell comprising:

a frame surrounding a periphery of the shell;

a dividing wall homogeneously formed with the frame and separating a plurality of recesses;

a plurality of connector inserts homogeneously formed with the frame and the dividing wall, the connector inserts disposed within one or more of the recesses, each of the connector inserts comprising a body configured to hold a plurality of electrical contacts that protrude from each of a mating side and a loading side of the body, the electrical contacts configured to be mounted to a circuit board in a location proximate to the loading side and to mate with a plurality of electrical connectors in a location proximate to the mating side; and a keying feature integrally formed with the frame and comprising a plurality of holes, the holes being configured to receive a plurality of protrusions in order to orient the shell with respect to a mating connector.

2. The shell of claim 1, wherein at least one of the bodies of the connector inserts is formed as a unitary body.

3. The shell of claim 1, wherein at least one of the bodies of the connector inserts comprises a front section and a rear section, one of the front and rear sections being homogeneously formed with the frame as a unitary body with the other of the front and rear sections bonded thereto.

4. The shell of claim 1, wherein the connector inserts are configured to hold the electrical contacts to mate with an ARINC standard electrical connector.

5. The shell of claim 1, wherein the shell is a unitary body formed of a dielectric material.

6. The shell of claim 1, further comprising a second dividing wall and a plurality of power connector inserts, the second dividing wall being homogeneously formed with the frame and dividing a second plurality of recesses, the plurality of power connector inserts disposed within one or more of the second plurality of recesses and configured to hold a plurality of electrical contacts.

7. The shell of claim 6, wherein at least one of the power connector inserts is homogeneously formed with the frame and the second dividing wall as a unitary body.

8. The shell of claim 7, wherein at least one of the power connector inserts comprises a front portion and a rear portion, one of the front and rear portions being homogeneously formed with the frame and the second dividing wall as a unitary body, the other of the front and rear portions being bonded thereto.

9. A connector shell comprising:

a frame surrounding a periphery of the shell;

a dividing wall homogeneously formed with the frame and separating a plurality of recesses;

a plurality of connector inserts coupled to the frame and the dividing wall, the connector inserts disposed within one or more of the recesses, each of the connector inserts comprising a mounting portion of a body, the mounting portion configured to couple with a mating portion of the body, the mounting and mating portions configured to hold a plurality of contacts that protrude from a loading side of the body, the contacts configured to be mounted to a circuit board in a location proximate to the loading side, wherein at least one of the mounting and mating portions is homogeneously formed with the frame and the dividing wall as a unitary body; and a keying feature integrally formed with the frame and comprising a plurality of holes, the holes being configured to receive a plurality of protrusions in order to orient the shell with respect to a mating connector.

10. The shell of claim 9, wherein the mating portion of the body is separately formed from the mounting portion and bonded thereto.

11. The shell of claim 9, wherein the connector inserts are configured to hold the electrical contacts to mate with an ARINC standard electrical connector.

12. The shell of claim 9, wherein the shell is a unitary body formed of a composite plastic material.

13. The shell of claim 9, wherein the mounting and mating portions are homogeneously formed with the frame and the dividing wall as a unitary body.

14. The shell of claim 9, further comprising a second dividing wall and a plurality of power connector inserts, the second dividing wall being homogeneously formed with the frame and dividing a second plurality of recesses, wherein one or more of the power connector inserts is disposed within one or more of the second plurality of recesses and configured to hold a plurality of electrical contacts.

15. The shell of claim 14, wherein at least one of the power connector inserts is homogeneously formed with the frame and the second dividing wall as a unitary body.

16. The shell of claim 14, wherein at least one of the power connector inserts comprises a front portion and a rear portion, one of the front and rear portions homogeneously formed with the frame and the second dividing wall as a unitary body, the other of the front and rear portions bonded thereto.

* * * * *